United States Patent [19]

Spellman

[11] 4,009,897

[45] Mar. 1, 1977

[54] GARBAGE CAN AND LID TIE DOWN APPARATUS

[76] Inventor: Michael P. Spellman, Rte. 1, E. Lake Ida, Alexandria, Minn. 56308

[22] Filed: Apr. 23, 1976

[21] Appl. No.: 679,665

[52] U.S. Cl. ..... 292/258; 292/288; 220/85 CH

[51] Int. Cl.[2] ..... B65D 45/30; E05C 19/18

[58] Field of Search ..... 292/25 C, 258, 288, 292/DIG. 11; 220/1 T, 85 H, 85 CH

[56] References Cited

UNITED STATES PATENTS

| | | | |
|---|---|---|---|
| 207,642 | 9/1878 | Bradley | 292/288 |
| 1,084,817 | 1/1914 | Parkinson | 292/288 |
| 2,151,587 | 3/1939 | Cassileth | 292/288 |
| 3,174,787 | 3/1965 | Kolman | 282/288 |
| 3,291,515 | 12/1966 | Lierman | 292/288 |
| 3,731,964 | 5/1973 | Hyde | 292/258 |

*Primary Examiner*—Robert L. Wolfe
*Attorney, Agent, or Firm*—Clarence A. O'Brien; Harvey B. Jacobson

[57] ABSTRACT

An integrally formed hold down device for securing the lid of a garbage can which also maintains the garbage can itself in upright position, comprising a resilient one-piece tension strap having three strap extension portions terminating in three looped portions for attachment, two to the side handles of the can and the third loop and its extension portion threaded through the top handle of the lid, which loop may secure the can to a hook on an outside member, such as fence post or wall, or alternately serve as a handle.

9 Claims, 4 Drawing Figures

GARBAGE CAN AND LID TIE DOWN APPARATUS

BACKGROUND OF THE INVENTION

Field of the Invention

The problems of animals removing lids from garbage cans in their search for food, knocking over the cans, and the ensuing mess of strewn refuse, unsightly, attracting rat infestations and making needless work, is well known. Strong winds often topple garbage cans and with the same undesirable results.

Tension straps to retain the lids on the cans are well known. For example, Remig U.S. Pat. No. 3,363,924 discloses the use of flat endless rubber bands, knotted about the lid handle and secured to the side can handles by metal hooks. Williams U.S. Pat. No. 3,589,760 discloses a garbage can clamp having a tension cord of nylon secured as by a turnbuckle to a steel coil spring and associated with metal hooks to engage the side handles of the can. Kolman U.S. Pat. No. 3,174,787 discloses an integrally molded tension strap about ¼ inch in diameter having protuberances adapted to be used with a hook member to secure garbage can lids. The present invention eschews the use of accessory members such as metal hooks and accomplishes its twofold task of lid hold down and can positioner with a single integrally formed tension strap.

SUMMARY OF THE INVENTION

It is the purpose of this invention to provide a lid hold down and a can positioner or strap holder without ancillary parts — no metal hooks, springs or the like, but a strong integrally formed member which is simple in design and inexpensive to manufacture, which can be secured and released with one hand, is long lasting and made of weatherproof material.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
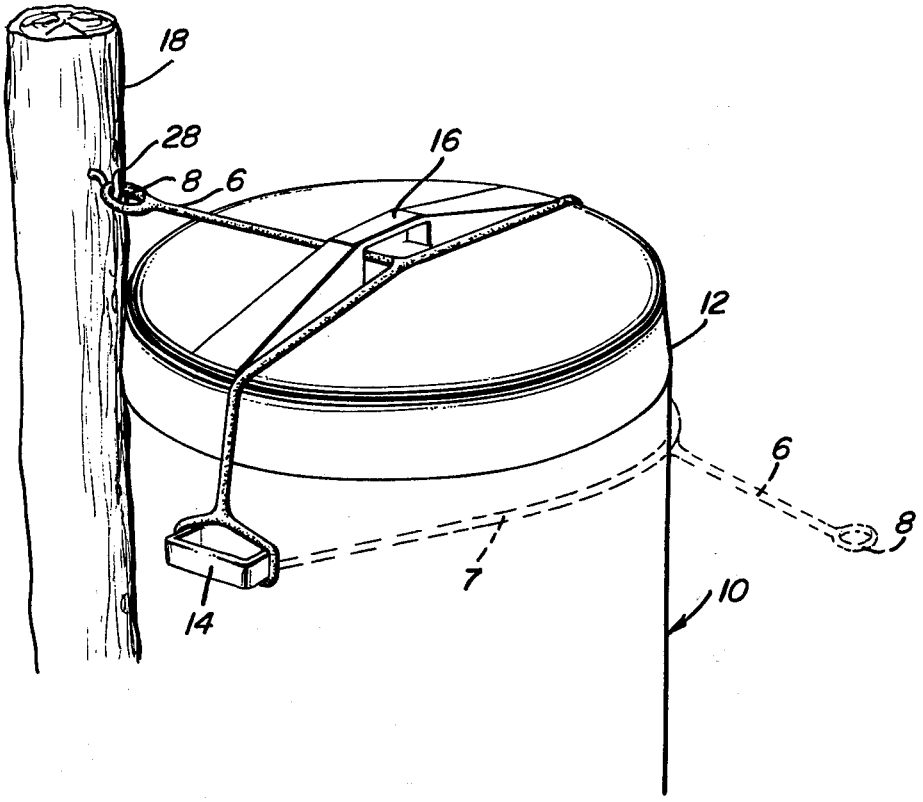
FIG. 1 is a perspective view of the lid and can retainer in use.
Figure 2:
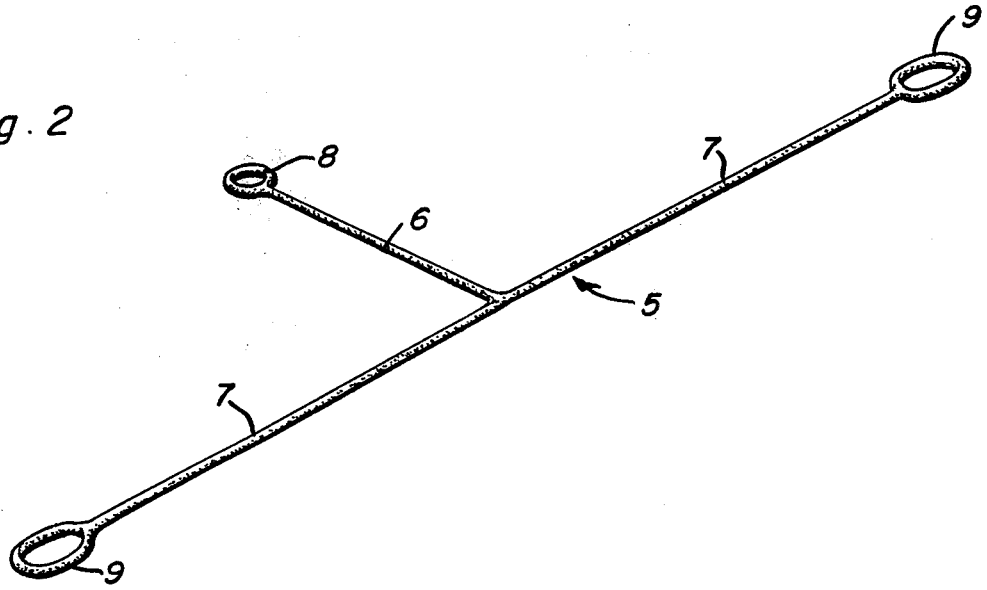
FIG. 2 is a view of the device in its extended position.
Figure 3:
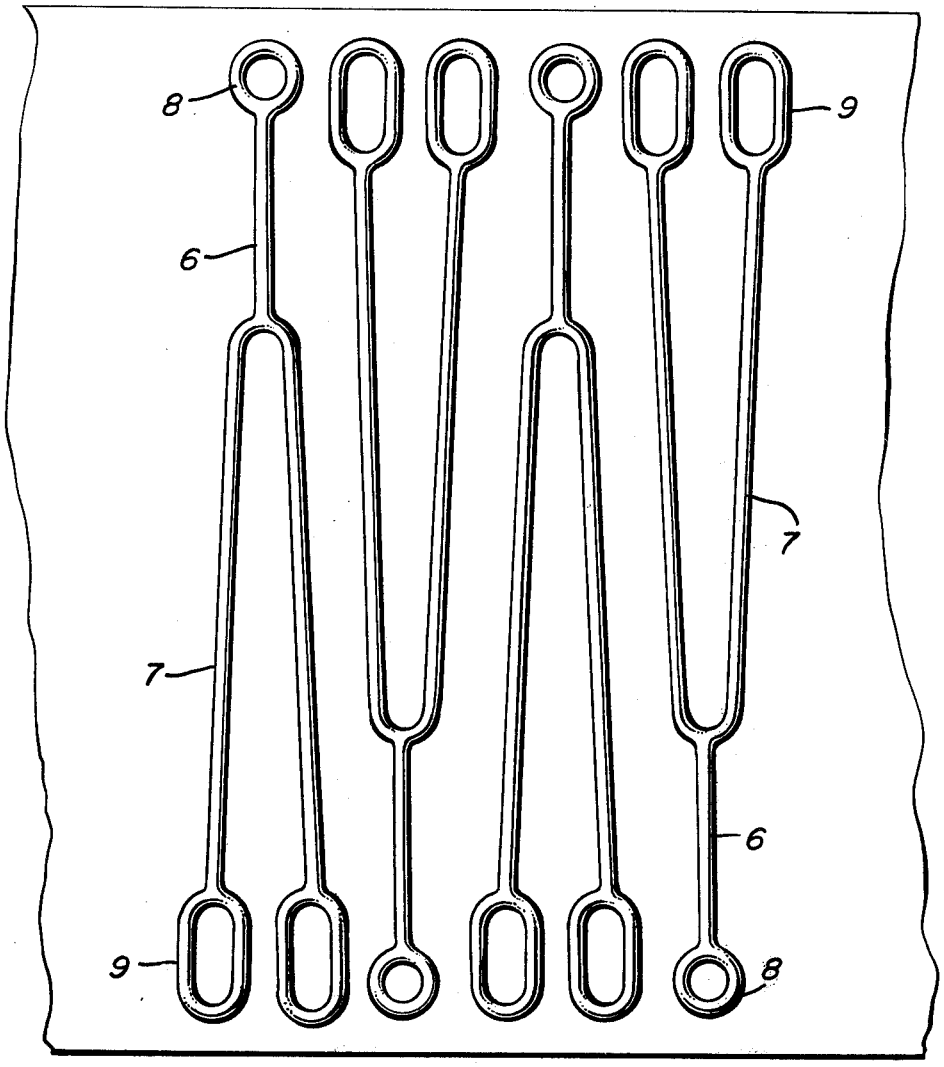
FIG. 3 is a layout of the hold down as manufactured.
Figure 4:
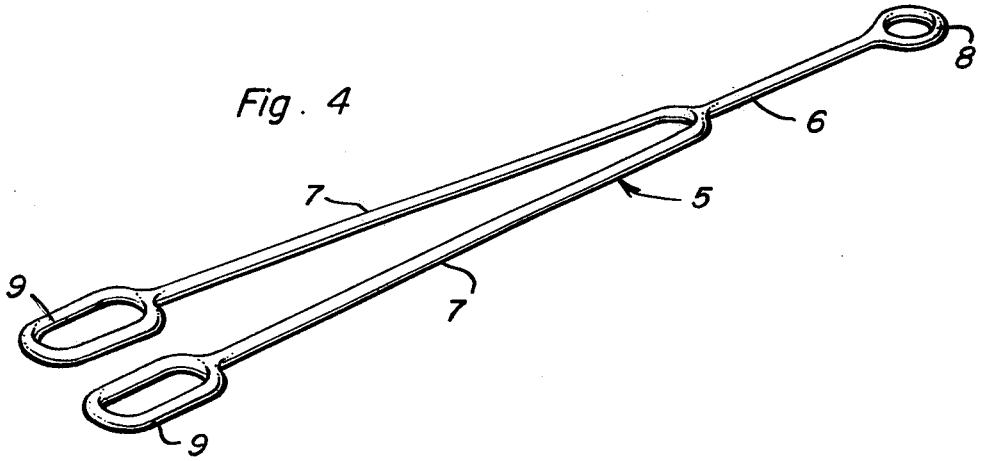
FIG. 4 is a view of the hold down in relaxed position.

Like reference characters indicate like parts throughout the figures of the drawings. Numeral 10 indicates generally a garbage can having a lid 12, side handles 14 and a top lid handle 16. In FIG. 1, post 18 having a hook 28 is shown. The hold down is indicated as 5 and shown in its relaxed position in FIG. 4, comprises a resilient strap member which may be integrally molded of a waterproof all elastic material in a multiple mold, as indicated in FIG. 3, which uses an alternate placement pattern for the most efficient use of space. It could also be stamped out from sheet material in a similar alternate pattern to conserve material. The hold down device 5 comprises a circular loop 8 of approximately 1 inch in diameter having a main stem or body portion 6 which is approximately 8¾ inches long and which bifurcates to form two legs 7, 7 approximately 11⅜ inches long, each terminating in an elongated elliptical loop 9 having a major axis 1⅜ inches long and an minor axis 1 inch wide. The bifurcation and junctures of all stems, legs and loops are curved so that no weak edge is presented which is susceptible to tearing and wearing. The cross-sectional diameter of the molded strap material is ¼ inch round.

The tie down may be applied to a 20 gallon capacity garbage can as well as a 30 gallon can. Every portion of the hold down is capable of extension ranging from 20% to 40% over its original length.

In operation, the resilient hold down strap 5 is extended across the width of the can cover 12, as shown in FIG. 1, with the elongated elliptical loops 9 stretched around the side handles 14 of the can to hold the lid down. The stem portion 6 is then run through the top handle 16 of the lid, and loop 8 engages a hook, such as 28 in an outside member, such as a wall, post or fence to prevent overthrow of the can. In view of the latter attachment, the members 6, 8 may be used as a carrying handle. To remove the lid hold down, hook 8 is disengaged and the stretched legs 7, 7 are pulled to the front of the can, see the phantom lines in FIG. 1. This can be achieved with one hand. The device as shown in FIG. 1 constitutes a three point hold down arrangement.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An integrally formed resilient tension strap constituting a hold down for garbage can lids and a can retainer, comprising a main stem having a loop formed at one end and bifurcated at the other end to provide two leg members each terminating in an elongated loop which leg members are adapted to be stretched across a garbage can lid and which elongated loops are adapted to encircle the side handles of a garbage can, the first loop and main stem may be threaded through the cover handle to the side opposite the leg extension to provide a three point hold down arrangement to prevent removal of the lid and upset of the can.

2. In an integrally formed resilient tension strap as in claim 1, wherein the two leg members are each longer than the main stem of the strap.

3. In a resilient tension strap as in claim 1 wherein the first named loop and the main stem are used as a lift handle.

4. In a resilient tension strap as in claim 1 wherein the first named loop and stem may be detached, pulled back through the lid handle until it is at the same side as the stretched leg members where it can be used with one hand to pull the stretched leg members out to the periphery of the lid and so release the lid from the can.

5. In a resilient tension strap as in claim 1 wherein the resilient tension strap is made of a waterproof elastic material.

6. In a resilient tension strap as in claim 5 wherein the resilient hold down strap has a stretch capacity in the 20% to 40% range.

7. In a resilient tension strap as in claim 1 wherein the resilient hold down strap is ¼ inch in cross-sectional diameter.

8. In a resilient tension strap as in claim 1 wherein the bifurcation presents a rounded crotch portion.

9. In a resilient tension strap for garbage can lids as in claim 8 wherein all junctures of loops, stem and legs of the one-piece integrally formed resilient strap are rounded for strength.

* * * * *